US005348089A

United States Patent [19]

Brandell et al.

[11] Patent Number: 5,348,089

[45] Date of Patent: Sep. 20, 1994

[54] METHOD AND APPARATUS FOR THE MULTIPLE STAGE CEMENTING OF A CASING STRING IN A WELL

[75] Inventors: John T. Brandell; Alan B. Duell, both of Duncan; Lee W. Stepp, Comanche, all of Okla.

[73] Assignee: Halliburton Company, Duncan, Okla.

[21] Appl. No.: 107,486

[22] Filed: Aug. 17, 1993

[51] Int. Cl.[5] ..... E21B 33/14; E21B 34/14

[52] U.S. Cl. ..... 166/154; 166/317; 166/318; 166/289; 166/291

[58] Field of Search ..... 166/154, 318, 317, 289, 166/332, 291, 194, 373

[56] References Cited

U.S. PATENT DOCUMENTS

| | | | |
|---|---|---|---|
| 2,998,075 | 8/1961 | Clark, Jr. | 166/318 |
| 3,228,473 | 1/1966 | Baker | 166/318 X |
| 3,768,556 | 10/1973 | Baker | 166/154 |
| 3,789,926 | 2/1974 | Henley et al. | 166/154 X |
| 4,246,968 | 1/1981 | Jessup et al. | 166/318 X |
| 4,260,017 | 4/1981 | Nelson et al. | 166/289 X |
| 4,479,545 | 10/1984 | Eley | 166/318 |
| 5,137,087 | 8/1992 | Szarka et al. | 166/289 |

*Primary Examiner*—Stephen J. Novosad
*Attorney, Agent, or Firm*—James R. Duzan; Stephen R. Christian; Michael L. Lynch

[57] ABSTRACT

The present invention provides a cementing tool for cementing multiple stages within a well. The assembly includes a housing assembly which defines one or more cementing ports. A first sleeve assembly is retained within the housing and is movable from a first position, where the sleeve covers the port, and thereby precludes fluid flow therethrough, to a second position wherein the sleeve opens the cementing port. The apparatus also includes a second sleeve assembly which is movable from a first position away from the cementing port to a second position wherein the sleeve assembly covers the port. The first sleeve is cooperatively configured with the housing assembly to provide engaging surfaces which resist rotation of the first sleeve relative to the housing. Additionally, the first sleeve and the second sleeve assembly are configured to limit relative rotation when the two pieces are longitudinally adjacent one another.

9 Claims, 4 Drawing Sheets

METHOD AND APPARATUS FOR THE MULTIPLE STAGE CEMENTING OF A CASING STRING IN A WELL

BACKGROUND OF THE INVENTION

The present invention relates generally to methods and apparatus for cementing a well; and, more specifically, relates to methods and apparatus for multiple stage cementing particularly useful in cementing operations performed within an existing casing string; otherwise known as "secondary cementing" operations.

Secondary cementing procedures are utilized in wells during their productive lives, such as remedial cementing and repairs to existing cemented areas. This may be necessitated by a number of occurrences. For example, the inside surface of an existing casing string will often corrode or otherwise deteriorate over time, thereby decreasing fluid flow through the string. In addition, the corrosion may cause the casing string to become fluid permeable, thereby leading to fluid leakage. At such times, secondary cementing may be utilized to repair the deteriorated section of casing. In such operations, when the well cannot be cemented from the bottom of the casing, it is often preferable to cement the annulus in two or more stages. For example, two stage cementing may be necessitated when the formation will not support a column of cement slurry over the vertical zone to be cemented.

Conventional multi-stage cementing tools have suffered from the deficiencies of either being too large in diameter to be satisfactorily utilized in workover operations, or of having components which are relatively difficult to drill out to provide an optimally open bore through the casing once the operation is completed.

Accordingly, the present invention provides a new multi-stage cementing tool and system configured to provide an optimally minimized outer diameter, and having internal components adapted to facilitate drilling out of the components facilitating the establishing of a full open bore after the cementing operation is completed.

SUMMARY OF THE INVENTION

The present invention provides a new method and apparatus for cementing muitiple stages within a well. The apparatus includes a housing assembly which will define at least one cementing port, and which will preferably define a plurality of cementing peas. A first sleeve assembly is retained within the housing and is movable from a first position wherein the sleeve covers the cementing port, and thereby precludes fluid flow therethrough, to a second position wherein the sleeve opens the cementing port.

The apparatus also includes a second sleeve assembly which is movable from a first position away from the cementing port, to a second position wherein the second sleeve assembly covers the port and precludes fluid flow therethrough. The housing assembly preferably defines an inwardly extending tapered shoulder surface which cooperates with a tapered surface on the first sleeve assembly such that the shoulder surface and the first sleeve surface are cooperatively engageable. In a particularly preferred embodiment, the first and second sleeve assemblies are longitudinally movable relative to said housing, and therefore relative to said port, and said inwardly extending shoulder of said housing defines the second position of the first sleeve.

In this particularly preferred embodiment, the apparatus will include an engagement system, such as a lug and slot between the first sleeve and the closing seat, to minimize relative rotation between the two members when the two members are proximate one another. Accordingly, after the second sleeve assembly is moved to its second position, the closing seat may be released from the closing sleeve and moved to a third position. In the stage of operation, the first sleeve is in the described second position, and the closing seat is in a third position. In these positions, the first sleeve assembly will engage the inwardly extending shoulder of the housing to prevent relative rotation between the first sleeve assembly and the housing assembly, thereby facilitating the "drilling out" of the members to establish an open bore.

DETAILED DESCRIPTION OF A PREFERRED EMBODIMENT

Figure 1:
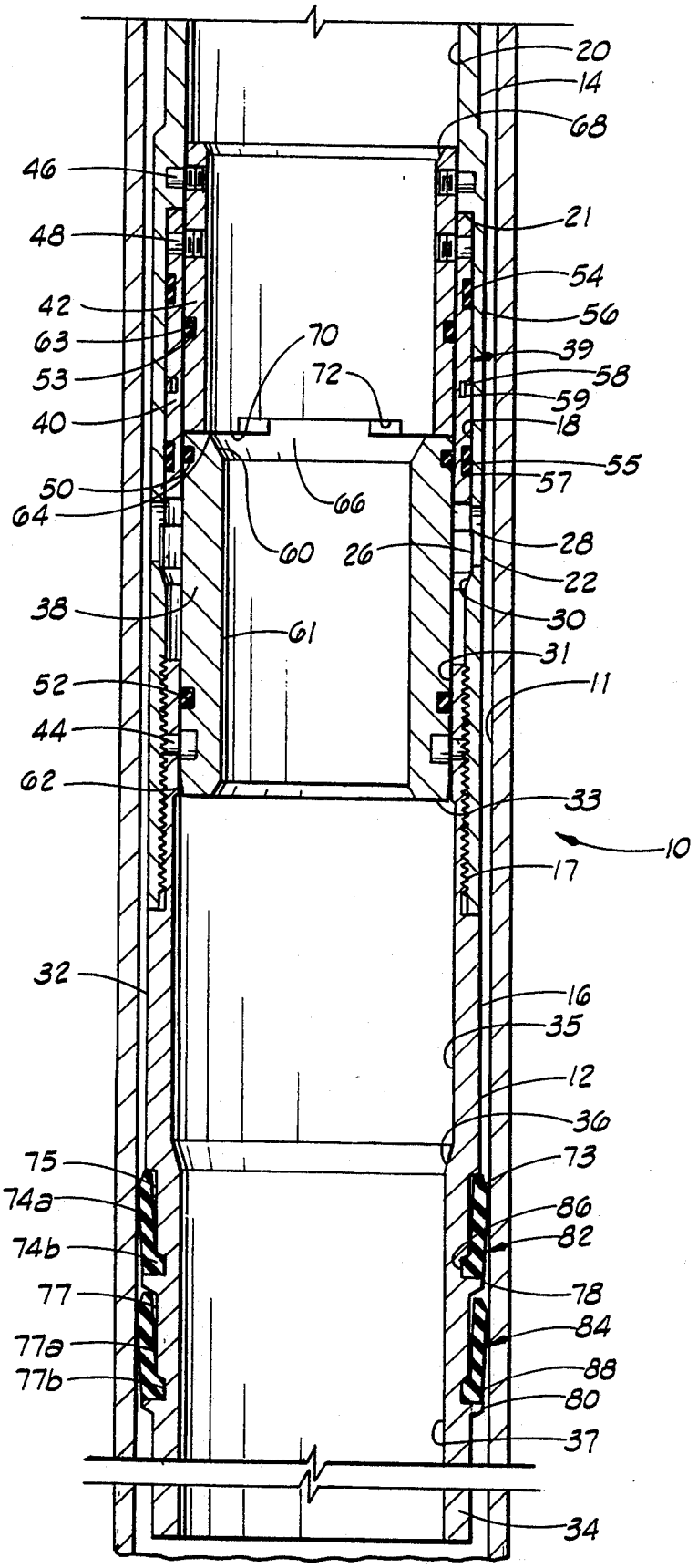
FIG. 1 depicts an exemplary multi-stage cementing tool in accordance with the present invention, depicted in a first, unactuated and closed, position; and illustrated partially in vertical section.

Referring now to FIG. 1, therein is depicted an exemplary embodiment of a multi-stage cementing tool in accordance with the present invention, indicated generally at 10. In an intended operation, multi-stage cementing tool 10 will be coupled in a string of casing or tubing to form a cementing assembly in a manner well-known to those skilled in the art. The assembly will then be lowered into the wellbore to a depth at which it is desired to cement the assembly in place.

Multi-stage cementing tool 10 includes a housing assembly 12 having an upper housing section 14 and a lower housing section 16. Upper housing section 14 defines a first, upper, bore 20 and a longitudinally offset, but generally coaxial, second, lower, bore 18. Upper bore 20 is of a first, relatively small, diameter, while lower bore 18 is of a relatively enlarged diameter. The transition between upper and lower bores 20 and 18 is abrupt, forming a shoulder 21.

Upper housing section 14 includes a plurality of generally radial ports 22 providing fluid communication between the interior and exterior of housing assembly 12 proximate lower bore 18 of upper housing section 14. In one preferred embodiment, two generally diametrically opposed ports 22 are provided in upper housing section 14. The inner surface of upper housing section 14 includes an annular recess 26 which extends partially across the horizon at which ports 22 are located, establishing a band having a diameter greater than that of lower bore 18. At the upper end of annular recess 26, the transition between annular recess 26 and lower bore 18 of upper housing section 14 is abrupt, forming a shoulder 28. At the lower end of annular recess 26, the transition between annular recess 26 and lower bore 18 is relatively gradual, forming a tapered shoulder 30.

Upper housing section 14 is preferably coupled to lower housing section 16 through a threaded coupling 17. Lower housing section 16 defines a first, upper, generally longitudinal bore 31 having an internal diameter essentially equal to that of upper bore 20 of upper housing section 14. Lower housing section 16 further includes a longitudinally offset second, intermediate, bore 35 having a relatively enlarged internal diameter. The transition between upper and intermediate bore sections 31 and 35 is relatively abrupt, forming a shoulder 33. Below second (intermediate) bore section 35 is a third bore 37 having an internal diameter which is relatively reduced relative to the diameters of bore sections 31 and 35. A tapered transition zone 36 is located between second (intermediate) bore section 35 and third bore section 37. Tapered transition zone 36 provides a smooth transition from the relatively large inside diameter in second bore section 35 to the relatively smaller inside diameter in third bore section 37 of lower housing 16. Upper, intermediate and lower bores 31, 35 and 37, respectively, of lower housing 16 are generally coaxial with one another, and are coaxial with upper and lower bores 18 and 20 of upper housing 14 when upper housing 14 and lower housing 16 are threadably coupled at 17 to form housing assembly 12.

Multi-stage cementing tool 10 includes an annular opening sleeve 38 and a closing sleeve assembly 39. Closing sleeve assembly 39 includes a closing sleeve 40 and a closing seat 42. In a first, unactuated, position, opening sleeve 38 isolates ports 22 in upper housing 14. First opening sleeve 38 is releasably secured in the unactuated position relative to housing assembly 12 by a plurality of shear pins 44. In one preferred embodiment, two shear pins 44 are used.

Closing sleeve 40 is preferably an annular member which will selectively seal ports 22 in upper housing 14. Closing sleeve 40 is initially coupled to closing seat 42 by a plurality of releasable members, such as shear pins 48. Closing seat 42 will be initially retained within upper end bore 20 and partially adjacent shoulder 21 by a plurality of shear pins 46. Shear pins 46 engage both closing seat 42 and upper housing section 14, and will initially retain closing seat, 42, and thereby closing sleeve 40, in a first, unactuated, position. In one preferred embodiment, closing seat 42 is retained in position by shear pins 46 and closing sleeve 40 is retained in position by shear pins 48. Closing sleeve assembly 39 will therefore be releasable as a unit from upper housing 14 prior to the releasing of closing seat 42 from closing sleeve 40.

Closing seat 42 and opening sleeve 38 are formed of any relatively rigid material which will be relatively drillable during drillout of closing seat 42 and opening sleeve 38. In a preferred embodiment, closing sleeve 42 and opening sleeve 38 are formed of aluminum. However, if aluminum does not provide sufficient integrity for a given application, closing sleeve 42 and opening sleeve 38 can also be formed of cast iron. Closing sleeve 40 can be formed of any rigid material which will resist deterioration. Closing sleeve 40 is preferably formed of steel.

A sealing member, such as an 0-ring 50 provides a fluid-tight seal between opening sleeve 38 and closing sleeve 40 when multi-stage cementing tool 10 is in the unactuated, or closed, position, as shown in FIG. 1. In a like manner, another sealing member, such as 0-ring 52, provides a fluid-tight seal between the outside surface of opening sleeve 38 and upper bore 31 of lower housing 16. A set of seals 54 and 55 retained within grooves 56 and 57, respectively, provide a fluid-tight seal between the outer surface of closing sleeve 40 and the inner surface defining lower bore 18 of upper housing 14. An 0-ring 63 retained in a groove 53 in closing seat 42 provides a fluid-tight seal between closing sleeve 40 and closing seat 42. A locking ring 58 is retained in an annular groove 59 around the outer surface of closing sleeve 40. Locking ring 58 is an expanding-type split ring, as will be further discussed below.

The circumferential surface of opening sleeve 38 includes one or more upwardly extending lugs 66 extending from proximate its upper end surface. The inner surface proximate the upper end of central bore 61 of opening sleeve 38 includes an annular taper to from a tapered seat 60. The lower end of opening sleeve 38 includes an externally tapered end to establish a circumferential chamfer 62. In one preferred embodiment, chamfer 62 of opening sleeve 38 has the same inclination as the inclination of tapered transition zone 36 in lower housing 16. However, the inclinations of the two tapered sections may be different. Chamfer 62 preferably includes a plurality of narrow longitudinal channels or grooves 65 from the lower end of opening sleeve 38 to the outer surface of opening sleeve 38 proximate shear pins 44.

The lower circumferential lip 70 of closing seat 42 includes a circumferential recess 72. Lug 66 of opening sleeve 38 extends a smaller circumferential distance around upper lip 64 of opening sleeve 38, than the dimension of slot 72 around lower lip 70 of closing seat 42. When multi-stage cementing tool 10 is in an unactuated, closed, position, lug 66 extends into slot 72. Closing seat 42 includes a taper at its upper inner surface to form a tapered seat 68.

Lower housing section 16 includes a first, relatively large, outside diameter in upper region 32. Longitudinally adjacent and below upper region 32 is first packer seal receiving groove 75. The transition between upper region 32 and first packer receiving groove 75 is relatively abrupt, forming shoulder 73. In one preferred embodiment, shoulder 73 is located on the outer surface of lower housing 16 proximate and below the location on the outer surface which corresponds to tapered transition zone 36 on the inner surface of lower housing 16.

First annular packer receiving groove 75 includes first and second component annular grooves **74*a* and 74*b*. First component annular groove 74*a* is relatively wide while second component annular groove 74*b* is lower, and relatively deeper. Similarly, a second packer receiving groove 76 includes a relatively wide portion 77*a* and lower, relatively deeper, portion 77*b*. Adjacent and below first annular groove 75, and above annular groove 76 is a first annular ridge 78. Adjacent and below second annular groove 76 is a second annular ridge 80. The outside diameters of first and second annular ridges 78, 80 are preferably equal. The remainder of lower region 34 of lower housing 16 below second annular ridge 80 is of a relatively reduced diameter compared to that of upper region 32**.

A first packer cup 82 extends around lower mandrel 16, and is retained in first packer retaining groove 75. First packer cup 82 is preferably of a tapered radius, such that the diameter at the upper end of first packer cup 82 is greater than the diameter at the lower end of first packer cup 82. First packer cup 82 smoothly tapers from the diameter at the lower end of first packer cup 82 to the diameter at the upper end of first packer cup 82. Similarly, a second packer cup 84 is retained in second packer retaining groove 76. The diameter of the upper end of second packer cup 84 is similarly greater than the diameter at the lower end of second packer cup 84. Second packer cup 84 smoothly tapers from the diameter at the lower end of second packer cup 84 to the diameter at the upper end of second packer cup 84. Packer cups 82 and 84 are each provided at their lower ends with an inwardly-extending protrusion or lip 86, 88, respectively, which extends into and is seated in a respective deeper annular grooves 74*b*, 77*b*, respectively.

An exemplary operation of multi-stage cementing tool 10 is as follows. After multi-stage cementing tool 10 has been assembled, as shown in FIG. 1, the tool is inserted as a portion of a workover casing string into the borehole. The upper end of first packer cup 82 and second packer cup 84 are in contact with the inner surface of the existing casing sidewalls as the workover casing string and associated multi-stage cementing tool 10 are lowered into the borehole.

When multi-stage cementing tool 10 is at the desired depth, a spacer fluid is generally pumped down the workover casing string to clear mud and other debris out of the string. Such "spacer plug," may be a conventional apparatus known to the industry, typically including a mandrel with rubber wipers. The rubber wipers of the spacer plug clean the interior of the casing as the plug travels therethrough. The spacer plug also can be used to separate the spacer fluid from the first stage of cement slurry. However, the spacer plug is not required in applications where it is unimportant whether the spacer fluid and the cement slurry mix in the borehole annulus. After the spacer fluid, and the spacer plug (if a spacer plug is desired), has been pumped through the casing string, the first stage of cement slurry is pumped through the casing string, out of the bottom of the casing string and up into the surrounding annulus.

Figure 2:
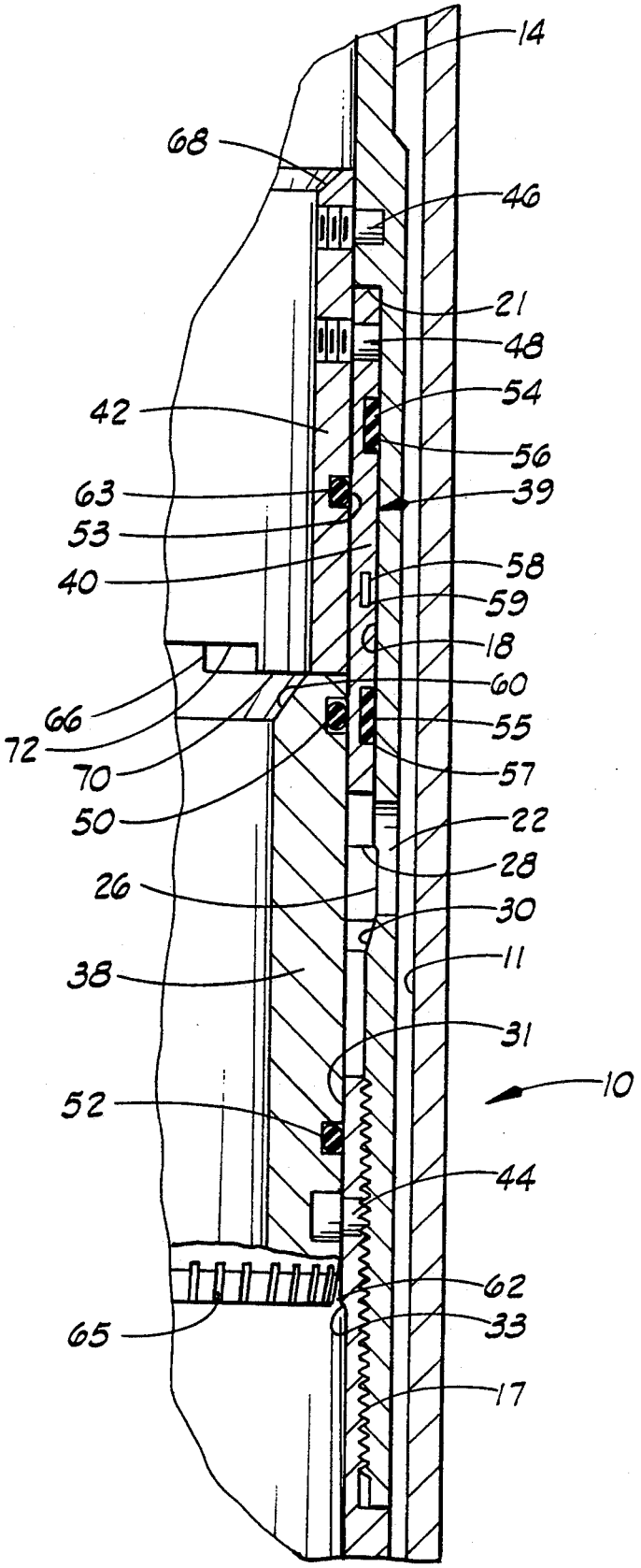
FIG. 2 depicts a portion of the tool of FIG. 1 in vertical section and in greater detail.
Figure 3:
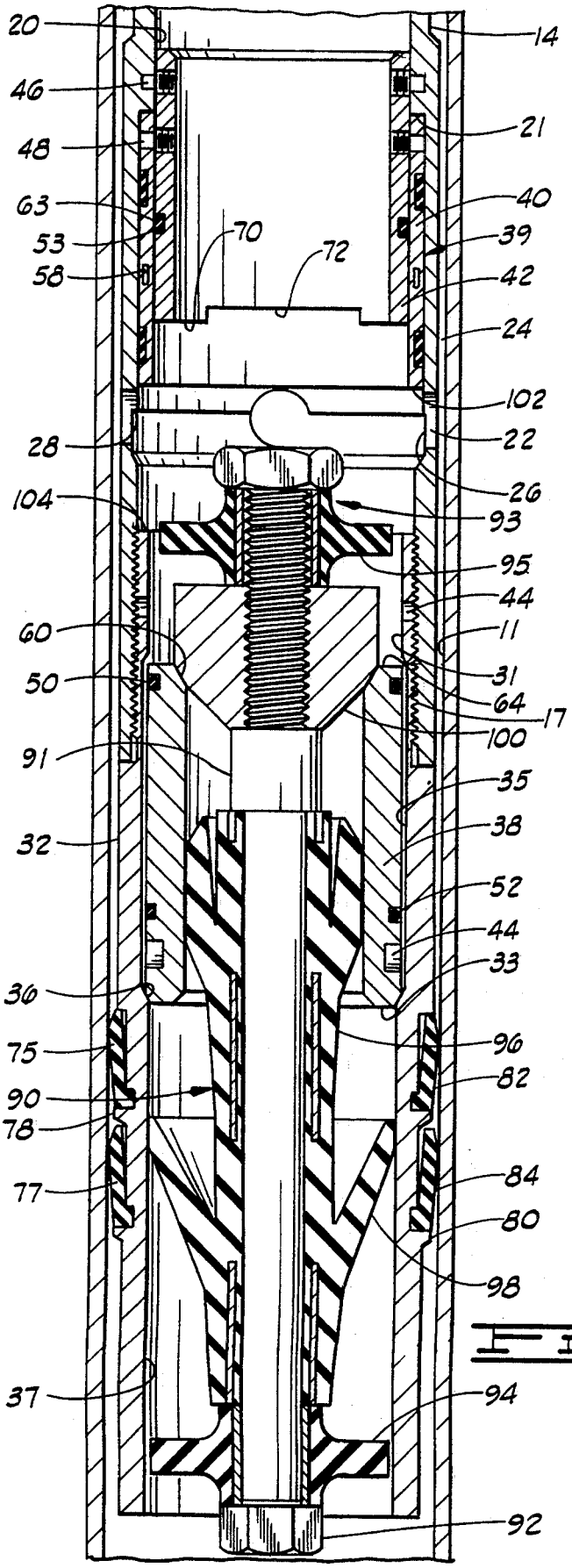
FIG. 3 depicts the multi-stage cementing tool of FIG. 1 in a second actuated, position, illustrated partially in vertical section.
Figure 4:
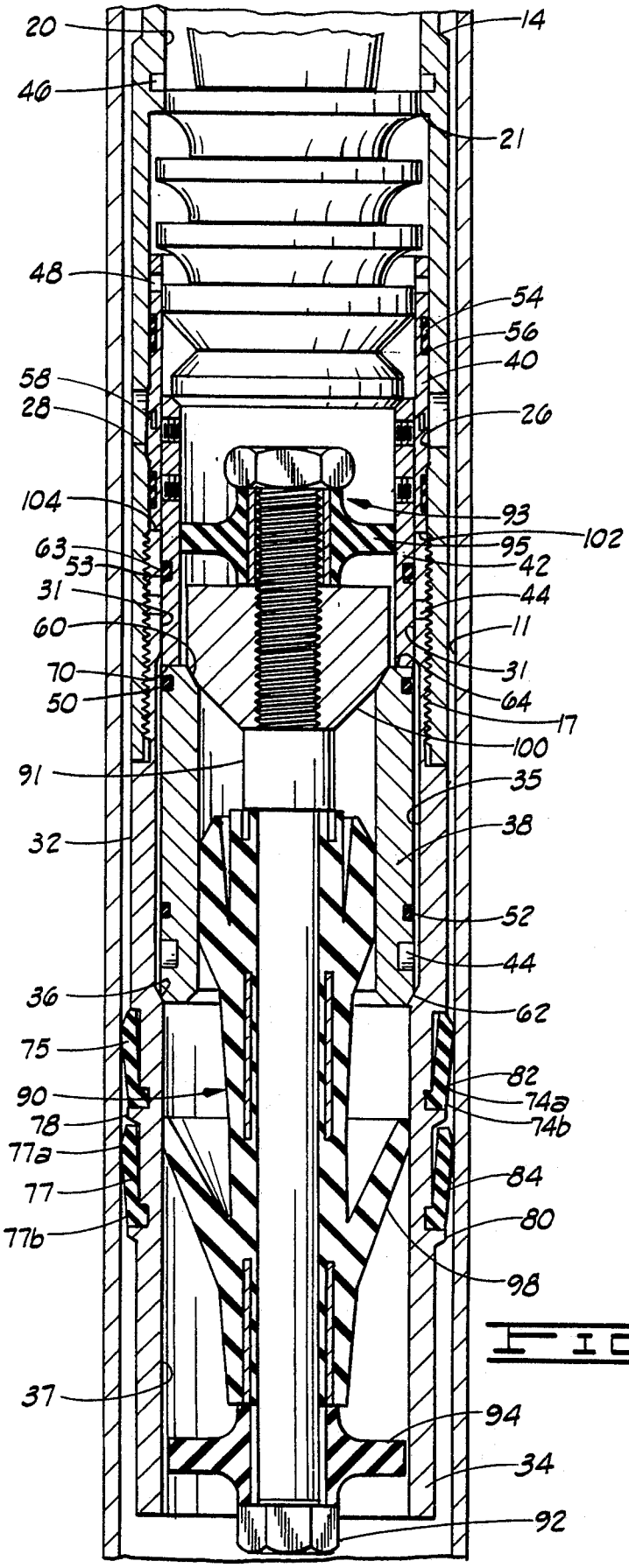
FIG. 4 depicts multi-stage cementing tool of FIG. 1. in a third, closed, position, illustrated partially in vertical section.

Referring now to FIGS. 2 and 3, after the first stage of cement slurry has been pumped, a sealing plug 90 is dropped through the casing string, or is displaced behind the first stage of slurry, to engage opening seat 38. Sealing plug 90 can be any of several plugs known to those skilled in the art. In this preferred embodiment, sealing plug 90 illustrated herein is a displacement-type plug. Sealing plug 90 includes coated body member 91, which is approximately 14 inches long. Body member 91 is provided at a lower end 92 with a first, lower, centralizer 94, and at its upper end 93 with second, upper, centralizer 95. Sealing plug 90 further includes upper and lower wipers 96, 98 between centralizers 94, 95. Centralizers 94 and 95 each have a decreased outside diameter compared to the outside diameter of wipers 96, 98 when wipers 96, 98 are fully extended. Centralizers 94 and 95, and wipers 96 and 98 are each preferably formed of an elastomeric material, such as rubber. Sealing plug 90 also includes a generally rigid seating block 100.

In this embodiment, the nominal diameter of centralizer 94 is greater than the inside diameter of, or bore through, opening sleeve 38. However, centralizer 94 will flex upward as sealing plug 90 continues downward, as will wipers 96, 98. Seating block 100 then seats in tapered seat 60 of opening sleeve 38. Sealing plug 90 is shown depicted with seating block 100 seated in tapered seat 60 of opening sleeve 38 in FIGS. 2 and 3. Seating block 100 has an outside diameter less than the inner diameter of closing seat 42, to enable seating block 100 to pass through closing seat 42 and seat in tapered seat 60.

After sealing plug 90 has been dropped or displaced from the surface and has engaged and seated in tapered seat 60 of opening sleeve 38, the multi-stage cementing tool 10 is still in the configuration shown in FIG. 1. As pressure is applied in the casing string above multi-stage cementing tool 10, shear pins 44 of opening sleeve 38 shear and opening sleeve 38 moves down from first bore section 31 and into second bore section 35 of upper region 32 of lower housing 16.

As opening sleeve 38 moves downwardly, 0-ring 52 passes shoulder 33 and enters second bore section 35. 0-ring 52 does not provide a fluid-tight seal in second bore section 35 because of the relatively enlarged diameter of second bore section 35 compared to that of first bore section 31. Opening sleeve 38 moves down until tapered region 62 of the outer surface of opening sleeve 38 engages and seats in tapered transition zone 36 of lower housing 16, as is shown in FIG. 2. Narrow grooves 65 provide fluid communication between upper housing 14 and lower region 34 of lower housing 16. With continuing reference to FIG. 2, ports 22 are exposed, thereby allowing fluid communication between the interior of the slimhole multi-stage cementing tool 10 and the borehole annulus.

At this time, the second stage of cement slurry is pumped down the tubing string and through ports 22 in upper mandrel 14 into the annulus 24, not shown on any of the Figures, of a well bore 11. When the second stage of cement slurry has been fully pumped through ports 22, a conventional, appropriately-sized closing plug 108 is pumped into the casing string. The closing plug 108 engages and seats in tapered seat 68 of closing seat 42. Closing seat 42 is held in a fixed position relative to upper mandrel 14 by shear pins 46. Pressure is applied within the workover casing until the pressure exceeds the design limits of shear pins 46. Shear pins 46 then shear and closing seat 42 moves downwardly. Since closing sleeve 40 is shear-pinned to closing seat 42 by shear pins 48, closing sleeve 40 moves downward with closing seat 42. Locking ring 58 associated with closing sleeve 40 expands into annular recess 26 of upper housing 14 after locking ring 58 passes shoulder 28 of annular recess 26. As has already been described, narrow channels or grooves 65 in tapered region 62 of outer surface of opening sleeve 38 provide fluid communication between upper mandrel 14 and lower region 34 of lower mandrel 16. Thus, fluid is prevented from being trapped between opening sleeve 38 and closing seat 42 as closing seat 42 moves down, thereby allowing closing sleeve 40 to fully close and seal ports 22.

0-rings 54, 55 provide a fluid-tight seal between closing sleeve 40 and second bore 18 of upper housing 14 below and above ports 22, respectively. Should a force act on closing sleeve 40 in an upward direction, locking ring 58 will engage shoulder 28 of annular recess 26, thereby inhibiting further movement upward of closing sleeve 40. Pressure indicators at the surface will indicate when closing sleeve 40 has closed ports 22 in upper mandrel 14.

When lower lip 102 of closing sleeve 40 contacts upper edge 104 of lower housing 16, closing sleeve 40 is restrained from further movement downward. When the pressure in the casing string exceeds the design limits of shear pins 48, shear pins 48 are sheared and closing seat 42 moves downwardly until lower lip 70 of closing seat 42 contacts upper lip 64 of opening sleeve 38. Extended lug 66 of opening sleeve 38 is received in slot 72 of closing seat 42 when upper lip 64 is in contact with lower lip 70 of closing seat 42. If either opening sleeve 38 or closing seat 42 rotate slightly during their respective downward motion, extended lug 66 will still be received in slot 72 of closing seat 42 because slot 72 extends further around the circumference of closing seat 42 than does extended lug 66 extend around the circumference of opening sleeve 38.

Opening sleeve 38 and closing seat 42 may be drilled out in a manner known to the art. Opening sleeve 38 is substantially prevented from rotation due to the force of friction between tapered transition zone 36 in lower mandrel 16 and tapered region 62 of opening sleeve 38. Likewise, closing seat 42 is prevented from rotating by the extended lug 66 and slot 72 combination.

If additional stages of operation are desired, inserts may be inserted inside and seated in closing seat 42 and opening sleeve 38. Such a modified multi-stage cementing tool may then be used in conjunction with multi-stage cementing tool 10 to facilitate pumping a third stage of cement into the annulus between the casing string and the existing casing string or well-bore. The modified tool is inserted in the casing string below slim-hole multi-stage cementing tool 10. A set of plugs having a relatively reduced outside diameter are used to actuate the modified slimhole multi-stage cementing tool. Then, slimhole multi-stage cementing tool 10 without modifications is actuated as discussed above.

The description of the present invention has been presented for purposes of illustration and description, but is not intended to be exhaustive or to limit the invention to the embodiments described and illustrated herein.

What is claimed is:

1. An apparatus for cementing multiple stages within a well, comprising:

a housing assembly, said housing assembly having at least one port therein;

a first sleeve retained within said housing, said sleeve movable from a first position covering said port to a second position opening said port;

a second sleeve assembly, said sleeve assembly movable from a first position away from said port to a second position covering said port;

said housing assembly further comprising an inwardly extending tapered shoulder, and said first sleeve comprising a tapered surface, said tapered shoulder and said tapered surface cooperatively engageable such that engagement of said tapered surface with said tapered shoulder establishes said second position of said first sleeve and such that said engagement of said tapered surface with said tapered shoulder inhibits rotation of said first sleeve relative to said housing assembly.

2. The apparatus of claim 1, wherein the angle of taper of said tapered shoulder of said housing assembly is different from the angle of taper of said tapered surface of said first sleeve.

3. The apparatus of claim 2, wherein said first sleeve and said second sleeve assembly are configured to be cooperatively engageable to establish a limited range of rotation between said first sleeve and, at least a portion of said second sleeve assembly when said first sleeve is in said second position, and wherein said portion of said second sleeve assembly is further in said second position.

4. The apparatus of claim 1, wherein said second sleeve assembly comprises a sealing sleeve and an actuation sleeve, said actuation sleeve releasably coupled to said sealing sleeve.

5. The apparatus of claim 4, wherein said actuation sleeve is cooperatively configured with said first sleeve to establish a limited range of relative rotation therewith when said actuation sleeve and said first sleeve are in said first, unactuated, positions.

6. The apparatus of claim 5, wherein said actuation sleeve and said first sleeve are also cooperatively engageable when each said sleeve is in its respective second position.

7. The apparatus of claim 4, wherein at least one of said tapered shoulder and said tapered surface include a groove to allow fluid passage between said two members.

8. A system for cementing multiple stages within a well, comprising:

a cementing valve assembly, comprising, a housing assembly, said housing assembly defining at least one radial port;

a first sleeve assembly, said first sleeve assembly slightly retained within said housing for longitudinal movement relative thereto, said sleeve moveable from a first position substantially covering said port to a second position substantially opening said port;

a second sleeve assembly retained within said housing for longitudinal movement relative thereto, said second sleeve assembly comprising a sealing sleeve and an actuation sleeve, said sealing sleeve releasably coupled to said actuation sleeve, said second sleeve assembly movable from a first position wherein said sealing sleeve is longitudinally above said port, to a second position wherein said sealing sleeve is substantially adjacent to and covering said port;

said housing defining a generally radially extending engagement surface, and said first sleeve including a tapered wedging surfaces, said surfaces cooperatively configured to establish a wedging engagement between said first sleeve and said housing assembly when said first sleeve is moved to said second position; and a first plug member selectively engageable with said first sleeve and adapted to block the flow fluid relative to said first sleeve such that the application of pressure above said first sleeve will cause movement of said first sleeve from said first position to said second position.

9. The system of claim 8, wherein said actuation sleeve is further movable to a third position relative to said housing assembly, and wherein said actuation sleeve and said first sleeve are cooperatively conformed to establish rotation limiting engagement between said actuation sleeve and said first sleeve when said first sleeve is in said second position and said actuation sleeve is in said third position.

* * * * *